United States Patent [19]

Johnston et al.

[11] Patent Number: 4,690,687

[45] Date of Patent: Sep. 1, 1987

[54] FUEL PRODUCTS COMPRISING A LEAD SCAVENGER

[75] Inventors: Thomas E. Johnston, Mentor; Casper J. Dorer, Jr., Lyndhurst, both of Ohio

[73] Assignee: The Lubrizol Corporation, Wickliffe, Ohio

[21] Appl. No.: 863,623

[22] Filed: May 14, 1986

Related U.S. Application Data

[63] Continuation-in-part of Ser. No. 766,615, Aug. 16, 1985.

[51] Int. Cl.[4] ..... C10L 1/30

[52] U.S. Cl. ..... 44/67; 44/68; 44/69; 44/76

[58] Field of Search ..... 44/67, 68, 69, 76

[56] References Cited

U.S. PATENT DOCUMENTS

| | | | |
|---|---|---|---|
| 2,151,432 | 3/1939 | Lyons et al. | 44/68 |
| 2,527,987 | 10/1950 | Caron et al. | 44/68 |
| 2,697,033 | 12/1954 | Ambrose et al. | 44/68 |
| 2,764,548 | 9/1956 | King et al. | 252/33 |
| 3,444,170 | 5/1969 | Norman et al. | 260/268 |
| 3,955,938 | 5/1976 | Graham et al. | 44/51 |
| 4,430,092 | 2/1984 | Rosenthal | 44/69 |
| 4,505,718 | 3/1985 | Dorer, Jr. | 44/68 |

*Primary Examiner*—Jacqueline V. Howard

*Attorney, Agent, or Firm*—Forrest L. Collins; Denis A. Polyn; Karl Bozicevic

[57] ABSTRACT

A fuel composition for internal combustion engines, and more particularly, a fuel composition for internal combustion engines containing less than about 0.5 gram of lead per gallon of fuel is described. The fuel provides acceptable valve seat protection in engines designed to operate on leaded fuels. A further aspect of the invention is to reduce deposit formation within the cylinders.

75 Claims, No Drawings

FUEL PRODUCTS COMPRISING A LEAD SCAVENGER

CROSS REFERENCE TO RELATED APPLICATION

This application is a continuation-in-part of U.S. Ser. No. 776,615 filed Aug. 19, 1985.

BACKGROUND OF THE INVENTION

This invention relates to fuel compositions for internal combustion engines and more particularly to fuel compositions which are characterized as being either unleaded or low lead fuels.

With the removal of lead additives such as, for example, tetraethyl lead and tetramethyl lead, from gasoline in order to reduce air pollution, it was discovered that the lead within the fuel had several desirable properties. It was found, for example, that the lead not only acted as an anti-knock agent, but was also effective in contributing toward the prevention of valve seat recession. In the conventional internal combustion gasoline engines, the exhaust valves generally seat against their valve seats with a slight rotary motion. This rotary motion is imparted to the valve stem during its operation to shift the relative position of the valve and to prevent uneven wear on the valve tip. The rotary motion also causes the valve to sit in different positions on each operation. With the elimination of the lead additives from gasoline, it has been found that a drastic increase in wear of the valve seat occurs. For example, see "Unleaded Versus Leaded Fuel Results in Laboratory Engine Tests", E. J. Fuchs, The Lubrizol Corporation, presented at the Society of Automotive Engineers National West Coast meeting, Vancouver, British Columbia, Canada, Aug. 16–19, 1971 (32 pages).

Valve seat wear is a function of engine design, load and speed conditions, and valve operating temperature. Valve seat wear is most severe under high speed and high load conditions. The problem of valve seat wear is observed in tractors, automobiles operated at high velocity, inboard and outboard motors, etc., especially when the internal combustion engines were designed primarily for leaded fuels.

Leaded fuels have typically been used with small amounts of organo halides to improve engine performance. See, for example, U.S. Pat. No. 4,430,092 to Rosenthal issued Feb. 7, 1984. The use of carbamate compounds for deposit control in internal combustion engines is discussed in U.S. Pat. No. 4,521,610 issued to Plavac on June 4, 1985.

Cyclopentadienyl manganese compounds are disclosed in U.S. Pat. No. Re. 29,488 to Gautreaux granted on Dec. 6, 1977. The Gautreaux patent teaches the manganese compounds as anti-knock additives in low-lead and no-lead fuels. Other manganese compounds stated to be useful are found in Graiff et al, U.S. Pat. No. 4,437,436 issued Mar. 20, 1984. Cobalt compounds for use in fuels are described in U.S. Pat. No. 4,131,626 to Moore et al issued Apr. 15, 1975. Copper compounds in fuels are described in U.S. Pat. No. 4,518,395 to Petronella issued May 21, 1985.

U.S. Pat. No. 2,764,548 to King et al, issued Sept. 25, 1956, describes motor oils and motor fuels containing various salts of dinonylnaphthalene sulfonic acid including the sodium, potassium, calcium, barium, ammonium and amine salts. The salts are reported to be effective rust inhibitors.

U.S. Pat. No. 3,506,416 to Patinkin, issued Apr. 14, 1970, describes leaded gasolines containing gasoline soluble salts of a hydroxamic acid of the formula RC(O)NHOH where R is a hydrocarbon group containing up to 30 carbon atoms. The metal may be selected from the Group Ia, IIa, IIIa, Va, Ib, IIb, IIIb, IVb, Vb, VIb, VIIb, VIII and tin.

U.S. Pat. No. 3,182,019, issued to Wilks et al on May 4, 1965, describes lubricating and fuel oils including complexes containing an alkali or alkaline earth metal carbonate in colloidal form.

The use of sodium in lead-free gasoline compositions for inhibiting valve seat recession is suggested in U.S. Pat. No. 3,955,938 to Graham et al, issued on May 11, 1976. The sodium may be incorporated into the fuel in a number of different forms such as sodium derivatives or organic compounds which are soluble, or dispersed in the gasoline. For example, simple sodium salts of an organic acid such as sodium petroleum sulfonate can be utilized although the sodium preferentially is added in the form of a sodium salt of an inorganic acid such as sodium carbonate in a colloidal dispersion in oil. Other convenient forms for introducing sodium into the fuel which are described in U.S. Pat. No. 3,955,938 include various sodium salts of sulfonic acids, sodium salts of saturated and unsaturated carboxylic acids, sodium salts of phosphosulfurized hydrocarbons such as may be prepared by reacting $P_2S_5$ with petroleum fractions such as bright stock, and sodium salts of phenols and alkylphenols. Various optional additives described by the Graham patent include corrosion inhibitors, rust inhibitors, anti-knock compounds, anti-oxidants, solvent oils, anti-static agents, octane appreciators, e.g. t-butyl acetate, dyes, anti-icing agents, e.g. isopropanol, hexyleneglycol, ashless dispersants, detergents, and the like. The amount of sodium additive included in the fuel is an amount to provide from about 0.5 to 20, preferably 0.5 to 10 lbs. of sodium per 1000 barrels of gasoline (2.86 g/1000 liters is 1 lb/1000 bbl).

It also has been suggested that gasoline compositions can be improved by including certain detergents and dispersants. U.S. Pat. No. 3,443,918 to Kautsky et al, issued May 13, 1969, describes the addition to gasoline of mono-, bis-, or tris-alkenyl succinimides of a bis- or tris-polymethylene polyamine. These additives are reported to minimize harmful deposit formation when the fuels are used in internal combustion engines.

U.S. Pat. Nos. 3,172,892 to LeSuer, issued Mar. 9, 1965; 3,219,666 to Norman, issued Nov. 23, 1966; 3,272,746 to LeSuer, issued Nov. 23, 1966; 3,281,428 also to LeSuer, issued Oct. 25, 1966; and 3,444,170 to Norman et al, issued May 13, 1969 are directed to polyalkenyl succinic type ashless additives, and the Norman '170 patent teaches the use of the additive disclosed therein as a fuel detergent. U.S. Pat. No. 3,347,645 to Pietsch et al, issued Oct. 17, 1967 also describes the use of alkenyl succinimides as dispersants in gasoline, but it is there noted that the dispersants promote aqueous emulsion formation during storage and shipping. U.S. Pat. No. 3,649,229 to Otto, issued Mar. 14, 1972, teaches a fuel containing a detergent amount of a Mannich base prepared using, among other reactants, an alkenyl succinic compound. U.S. Pat. No. 4,240,803 issued to Andress on Dec. 23, 1980 also relates to hydrocarbon fuel compositions containing a detergent amount of a specific alkenyl succinimide wherein the alkenyl group is derived from a mixture of C16–28 olefins.

Although sodium salts of organic acids have been suggested as being useful additives in gasoline, and in particular, low lead or unleaded gasolines, such sodium salts have a tendency to emulsify water into gasoline, and with some sodium salts an undesirable extraction of the sodium into the water occurs.

The use of some alkali metal or alkaline earth metal salts results in some circumstances in deposits being formed which insulate the combustion cylinder resulting in an octane requirement increase (ORI). Some deposits also raise the pressure upon compression by taking up headspace in the cylinder which results in an ORI. Glowing deposits may also cause preignition, thereby causing knock. It has been discovered through analysis that these deposits are of a carbonaceous-metal nature. It has now been found that such deposits may be lessened and the availability of the salt for valve seat protection effectively increased as described herein.

Throughout the specification and claims, temperatures are Celsius, percentage and ratios are by weight and pressures are in KPa gauge unless otherwise indicated. Publications cited herein are incorporated by reference.

SUMMARY OF THE INVENTION

This invention describes an unleaded fuel composition for an internal combustion engine comprising a major portion of a liquid hydrocarbon fuel and a minor amount of:

(a) a hydrocarbon soluble alkali metal or alkaline earth metal containing composition; and (b) a lead scavenger.

A further aspect of the present invention is a fuel composition for internal combustion engines comprising a major amount of a liquid hydrocarbon fuel and a minor amount of (a) a hydrocarbon-soluble alkali or alkaline earth metal containing composition and (b) a hydrocarbon-soluble member selected from the group consisting of aluminum containing compositions, silicon containing compositions, molybdenum containing compositions, lithium containing compositions, calcium containing compositions, magnesium containing compositions and mixtures thereof.

This invention also describes a fuel composition for internal combustion engines comprising a major amount of a liquid hydrocarbon fuel and minor amount of (a) a hydrocarbon-soluble alkali or alkaline earth metal containing composition and (b) a hydrocarbon-soluble transition metal containing composition.

A concentrate is prepared suitable for use in a fuel containing:

(a) a hydrocarbon soluble alkali metal or alkaline earth metal salt;

(b) a member selected from the group consisting of:

(1) lead scavenger;

(2) a hydrocarbon-soluble member selected from the group consisting of aluminum containing compositions, silicon containing compositions, molybdenum containing compositions, lithium containing compositions, calcium containing compositions, magnesium containing compositions and mixtures thereof; and (3) a hydrocarbon-soluble transition metal containing composition and mixtures thereof, and (c) a fuel-soluble or dispersible organic diluent.

A process is also described herein for reducing valve seat recession by including in an unleaded fuel a hydrocarbon soluble alkali metal or alkaline earth metal containing composition in an amount sufficient to lessen valve seat recession, and a sufficient amount of a scavenger compound capable of lessening the formation of deposits of the alkali metal of alkaline earth metal within the combustion cylinder.

DESCRIPTION OF THE INVENTION

The fuels which are contemplated for use in the fuel compositions of the present invention are normally liquid hydrocarbon fuels in the gasoline boiling range, including hydrocarbon base fuels. The term "petroleum distillate fuel" also is used to describe the fuels which can be utilized in the fuel compositions of the present invention and which have the above characteristic boiling points. The term, however, is not intended to be restricted to straight-run distillate fractions. The distillate fuel can be straight-run distillate fuel, catalytically or thermally cracked (including hydro cracked) distillate fuel, or a mixture of straight-run distillate fuel, napthas and the like with cracked distillate stocks. Also, the base fuels used in the formation of the fuel compositions of the present invention can be treated in accordance with well-known commercial methods, such as acid or caustic treatment, hydrogenation solvent refining, clay treatment, etc.

Gasolines are supplied in a number of different grades depending on the type of service for which they are intended. The gasolines utilized in the present invention include those designed as motor and aviation gasolines. Motor gasolines include those defined by ASTM specification D-439-73 and are composed of a mixture of various types of hydrocarbons including aromatics, olefins, paraffins, isoparaffins, napthenes and occasionally diolefins. Motor gasolines normally have a boiling range within the limits of about 20° C. to 230° C. while aviation gasolines have narrower boiling ranges, usually within the limits of about 37° C. to 165° C.

THE ALKALI OR ALKALINE EARTH METAL CONTAINING COMPOSITION

The fuel compositions of the present invention will contain a minor amount of (A) at least one hydrocarbon-soluble alkali or alkaline earth metal-containing composition. The presence of such metal-containing compositions in the fuel compositions of the present invention provides the fuel composition with a desirable ability to prevent or minimize valve seat recession in internal combustion engines, particularly when the fuel is an unleaded or low-lead fuel.

The choice of the metal does not appear to be particularly critical although alkai metals are preferred, with sodium being the preferred alkali metal.

The metal-containing composition (A) may be alkali metal or alkaline earth metal salts of sulfur acids, carboxylic acids, phenols and phosphorus acids. These salts can be neutral or basic. The former contain an amount of metal cation just sufficient to neutralize the acidic groups present in salt anion; the latter contain an excess of metal cation and are often termed overbased, hyperbased or superbased salts.

These basic and neutral salts can be of oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids.

The sulfonic acids include the mono- or poly-nuclear aromatic or cycloaliphatic compounds. The sulfonic acids can be represented for the most part by the following formulae:

$$R^1(SO_3H)_r \qquad \text{Formula I}$$

$$(R^2)_xT(SO_3H)_y \qquad \text{Formula II}$$

in which T is an aromatic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydronaphthalene, cyclopentane, etc; $R^1$ and $R^2$ are each independently aliphatic groups, $R^1$ contains at least about 15 carbon atoms, the sum of the carbon atoms in $R^2$ and T is at least about 15, and r, x and y are each independently 1 or greater.

Specific examples of $R^1$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, $R^1$ and $R^2$ in the above formulae can also contain other inorganic or organic substituents in addition to those enumerated above such as, for example, hydroxy, mercapto, halogen, nitro, amino, nitroso, sulfide, disulfide, etc. The subscript x is generally 1–3, and the subscripts r+y generally have an average value of about 1–4 per molecule.

The following are specific examples of oil soluble sulfonic acids coming within the scope of Formulae I and II above, and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. (37.7° C.) to about 200 seconds at 210° F. (99° C.); petrolatum sulfonic acids; mono- and poly-wax substituted sulfonic and polysulfonic acids of, e.g., benzene, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3 or more branched-chain $C_{12}$ substituents on the benzene ring. Dodecyl benzene bottoms, principally mixtures of mono- and di-dodecyl benzenes, are available as by-products from the manufacturer of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos.: 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,097; 2,315,514; 2,319,121; 2,321,022; 2,333,568; 2,333,788; 2,335,259; 2,337,552; 2,347,568; 2,366,027; 2,374,193; 2,383,319; 3,312,618; 3,471,403; 3,488,284; 2,595,790 and 3,798,012. These are hereby incorporated by reference for their disclosures in this regard. Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chlorosubstituted paraffin wax sulfonic acids, nitro-paraffin wax sulfonic acids, etc; cyclo-aliphatic sulfonic acids such as petroleum naphthene sulfonic acids, cetyl cyclopentyl sulfonic acids, lauryl cyclohexyl sulfonic acids, bis-(di-isobutyl)cyclohexyl sulfonic acids, mono- or poly-wax substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacturer of petroleum white oils by a sulfuric acid process.

The carboxylic acids from which suitable neutral and basic alkali metal and alkaline earth metal salts for use in this invention can be made include aliphatic, cycloaliphatic, and aromatic mono and polybasic carboxylic acids such as the naphthenic acids, alkyl- or alkenyl-substituted cyclopentanoic acids, the corresponding cyclohexanoic acids and the corresponding aromatic acids. The aliphatic acids generally contain at least eight carbon atoms and preferably at least twelve carbon atoms. Usually they have no more than about 400 carbon atoms. Generally, if the aliphatic carbon chain is branched, the acids are more oil soluble for any given carbon atom content. The cycloaliphatic and aliphatic carboxylic acids can be saturated or unsaturated. Specific examples include 2-ethylhexanoic acid, alpha-linolenic acid, propylenetetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oils acids, rosin acids, and the like.

A preferred group of oil-soluble carboxylic acids useful in preparing the salts used in the present invention are the oil-soluble aromatic carboxylic acids. These acids are represented by the general formula:

$$(R^*)_aAr^*(CXXH)_m \qquad \text{Formula III}$$

where R* is an aliphatic hydrocarbon-based group of at least four carbon atoms, and no more than about 400 aliphatic carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthlene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.) lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* group do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylenepropylene copolymers, and the like. Likewise, the group Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

A group of particularly useful carboxylic acids are those of the formula:

$$R^*_a Ar^*(CXXH)_m(XH)_p \qquad \text{Formula IV}$$

where R*, X, Ar*, m and a are as defined in Formula III and p is an integer of 1 to 4, usually 1 or 2. Within this group, an especially preferred class of oil-soluble carboxylic acids are those of the formula:

$$(R^{**})Ph_a(COOH)_b(OH)_c \qquad \text{Formula V}$$

where R in Formula V is an aliphatic hydrocarbon group containing at least 4 to about 400 carbon atoms, Ph is a phenyl group, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to 400 carbon atoms.

The carboxylic acids corresponding to Formulae III and IV above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252,664; 2,714,092; 3,410,798 and 3,595,791.

Another type of neutral and basic carboxylate salt used in this invention are those derived from alkenyl succinates of the general formula:

$$R^*CH(COOH)CH_2COOH \qquad \text{Formula VI}$$

wherein R* is as defined above in Formula III. Such salts and means for making them are set forth in U.S. Pat. Nos. 3,271,130; 3,567,637 and 3,632,610.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Neutral and basic salts of phenols (generally known as phenates) are also useful in the compositions of this invention and well known to those skilled in the art. The phenols from which these phenates are formed are of the general formula:

$$(R^*)_a—(Ar^*)—(OH)_m \qquad \text{Formula VII}$$

wherein R*, a, Ar*, and m have the same meaning and preferences as described hereinabove with reference to Formula III. The same examples described with respect to Formula III also apply.

The commonly available class of phenates are those made from phenols of the general formula:

$$(R')_a(R^4)_z Ph(OH)_b \qquad \text{Formula VIII}$$

wherein a is an integer of 1–3, b is of 1 or 2, z is 0 or 1, Ph is a phenyl group R' in Formula VIII is a substantially saturated hydrocarbon-based substituent having an average of from about 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) alkali and alkaline earth metal sulfurized phenates made by sulfurizing a phenol and described hereinabove with a sulfurizng agent such as sulfur, a sulfur halide, or sulfide or hydrosulfide salt. Techniques for making these sulfurized phenates are described in U.S. Pat. Nos. 2,680,096; 3,036,971 and 3,775,321.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof.

Alkali and alkaline earth metal salts of phosphorus acids also are useful in the fuel compositions of the invention. For example, the normal and basic salts of the phosphonic and/or thiophosphonic acids prepared by reacting inorganic phosphorus reagents such as $P_2S_5$ with petroleum fractions such as bright stock or polyolefins obtained from olefins of 2 to 6 carbon atoms. Particular examples of the polyolefins and polybutenes having a molecular weight of from 700 to 100,000. Other phosphorus-containing reagents which have been reacted with olefins include phosphorus trichloride or phosphorus trichloride-sulfur chloride mixture, (e.g., U.S. Pat. Nos. 3,001,981 and 2,195,517), phosphites and phosphite chlorides (e.g., U.S. Pat. Nos. 3,033,890 and 2,863,834), and air oxygen with a phosphorus halide (e.g., U.S. Pat. No. 2,939,841).

Other patents describing phosphorus acids and metal salts useful in the present invention and which are prepared by reacting olefins with phosphrous sulfides include the following U.S. Pat. Nos.: 2,316,078; 2,316,079; 2,316,080; 2,316,081; 2,316,082; 2,316,085; 2,316,088; 2,375,315; 2,406,575; 2,496,508; 2,766,206; 2,838,484; 2,893,959 and 2,907,713. These acids which are described in the above patents as being oil additives, are useful in the fuel composition of the present invention. The acids can be converted to neutral and basic salts by reactions which are well known in the art.

Mixtures of two or more neutral and basic salts of the herinabove described organic sulfur acids, carboxylic acids, phosphorus acids and phenols can be used in the compositions of this invention. Usually the neutral and basic salts will be sodium, lithium, magnesium, calcium, or barium salts including mixtures of two or more of any of these.

As mentioned above, the amount of alkali or alkaline earth metal containing composition (A) included in the fuel composition will be an amount which is sufficient to provide from about 1 to about 100 parts per million of the alkali metal or alkaline earth metal in the fuel composition. When utilized in lead free or low lead fuels, the amount of alkali metal or alkaline earth metal-containing composition (A) included in the fuel is an amount which is sufficient to reduce valve seat recession when the fuel is used in an internal combustion engine.

The following specific illustrative examples describe the preparation of exemplary alkali and alkaline earth metal compositions (A) useful in the fuel compositions of this invention.

EXAMPLE A-1

A mixture of 1000 parts of a primary branched sodium monoalkyl benzene sulfonate (M.W. of the acid is 522) in 637 parts of mineral oil is neutralized with the 145.7 parts of a 50% caustic soda solution and the excess water and caustic removed. The product containing the sodium salt obtained in this manner contains 2.5% sodium and 3.7% sulfur.

EXAMPLE A-2

The procedure of Example A-1 is repeated except that the caustic soda is replaced by a chemically equivalent amount of $Ca(OH)_2$.

EXAMPLE A-3

The procedure of Example A-1 is repeated except that the caustic soda is replaced by a chemically equivalent amount of KOH.

EXAMPLE A-4

A mixture of 906 parts of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°–85° C. for seven hours at a rate of about 3 cubic feet of carbon dioxide per hour (85 l/hr). The reaction mixture is constantly agitated throughout the carbonation. After carbonation, the reaction mixture is stripped to 165° C./20 torr (2.65 KPa) and the residue filtered. The filtrate is an oil solution of the desired overbased magnesium sulfonate having a metal ratio of about 3.

EXAMPLE A-5

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added with mixing, 1000 parts of an alkyl phenyl sulfonic acid having an average molecular weight (vapor phase osmometry) of 500. The mixture then is blown with carbon dioxide at a temperature of about 50° C. at the rate of about 5.4 lbs. per hour (40.8 g/minute) for about 2.5 hours. After carbonation, 102 additional parts of oil are added and the mixture is stripped of volatile materials at a temperature of about 150°–155° C. at 55 mm (7.3 KPa) pressure. The residue is filtered and the filtrate is the desired oil solution of the overbased calcium sulfonate having calcium content of about 3.7% and a metal ratio of about 1.7.

THE SCAVENGER

The first type of scavenger herein is a material which is capable of scavenging lead from within the cylinder of an internal combustion engine. While lead is, of course, not a component of an unleaded fuel, the alkali metal and alkaline earth metal salts mimic lead in their ability to form deposits on the spark plugs and portions of the cylinder. The deposits also contain large amounts of carbonaceous material which appears to be held together by the salt. The use of lead scavengers in the claimed compositions has the effect of reducing the deposit formation.

A second aspect of the present invention is the use of scavengers which enhance combustion in the engine. By decreasing the combustion temperature, the carbonaceous deposits are burned free of the cylinder walls and spark plugs. In the absence of the carbonaceous portion of the deposit, the ability of the salt to form an organic matrix is diminished. Hence, the scavenger, by burning the carbon, denies the salt the ability to adhere. The salt then follows the exhaust path from the combustion chamber.

A third form of scavenger is the deposit modifier. Various compounds are useful in affecting either the carbonaceous or the salt portion of the deposit to lessen the growth or adherence of the deposit on the cylinder wall.

The first class of materials which are useful herein are lead scavengers such as halogenated hydrocarbons. The halogenated hydrocarbons may be aromatic or aliphatic conventiently containing from 1 to about 30 carbon atoms. The halogenated hydrocarbons may also include other moieties such as oxygen or sulfur provided such other moieties are not deleterious to the primary scavenging effect. Additional lead scavengers are hydrocarbon-soluble carbamates and 1,4 tertiary dialkylbenzenes.

The halogenated hydrocarbons are typically short chained alkyls and contain at least two halogen atoms per molecule of the scavenger. The halogen is preferably chlorine, or secondarily bromine. Mixtures of halogenated hydrocarbons are also useful herein. Suggested halogenated hydrocarbons include ethylene dichloride, ethylene dibromide, trichloromethane, tribromomethane, dichlorobenzene, trichlorobenzene and mixtures thereof. The use of ethylene dichloride and etthylene dibromide in a respective weight ratio of about 10:1 to about 1:10, preferably 7:1 to 1:7 is suggested. Additional halogenated materials include trichloro ethylene; 1,1,2-trichloro ethane; tetrachloro ethylene; 1,1,2,2-tetrachloro ethane; pentachloro ethane; hexachloro ethane; 1,2,4-trichloro benzene; 1,2,4,5-tetrachloro benzene; pentachloro benzene, chloroform, bromoform, carbon tetrachloride and mixtures thereof.

The halogenated hydrocarbon is typically used with the alkali metal or alkaline earth metal containing composition on an equivalent ratio of the cation to the halogen. That is, for one mole of sodium, one half mole of ethylene dichloride would be utilized. For a calcium salt, two-thirds of a mole of trichlorobenzene is employed per mole of calcium in the salt.

Conveniently the equivalent ratio of the cation to the halogen present may vary from about 2:1 to about 1:15, preferably about 3:2 to about 1:7.

The second class of scavengers (which promote combustion) are typically transition metals. Any of the transition metals in a form which renders them hydrocarbon soluble may be utilized herein. Typically, the transition metal is in the form of a carboxylate, phenate or sulfonate. The preferred transition metals are manganese, cerium, copper, iron and titanium, most preferably manganese. See Dorer, U.S. Pat. No. 4,505,718 issued Mar. 19, 1985.

The combustion modifier type of scavenger is used in an amount sufficient to reduce the amount of carbonaceous deposits within the cylinder. Wile the nature of the carbonaceous deposit will vary with the fuel employed, the amount of alkali metal or alkaline earth metal within the deposit is controlled by the amount of salt present in the fuel. Thus, while it is desirable for all carbonaceous matter to be removed, it is only necessary that a sufficient amount be combusted to deny the salt a matrix within which to deposit.

Conveniently, the transition metal is present from about 5 ppm to about 500 ppm, preferably from about 10 ppm to about 300 ppm of the fuel. The scavenger of the combustion modifier type has the additional advantage of lessening any carbonaceous deposits present whether or not the salt is in the deposit matrix. Thus, octane requirement increases are minimized by removal of the deposits.

The third class of scavengers (the deposit modifier type) function to raise the melting point of the metals within the salt. As the melt point of the salt is raised, the salt retains a more crystalline character in the cylinder. As the salt is not free to melt and flow evenly over the cylinder, it has a less tenaceous hold on the cylinder wall. The crystalline nature of the salt allows for pieces of the deposit to break off and be forced out of the cylinder.

Among the deposit modifiers employed herein are the hydrocarbon-soluble forms of aluminum, magnesium, calcium, lithium, boron, silicon (typically from a polysiloxane type silicon oil) and molybdenum. As previously noted, any of the hydrocarbon-soluble forms of the foregoing materials may be utilized herein. For instance, the molybdenum compounds obtained in U.S. Pat. No. 4,266,945 to Karn issued May 12, 1981 may be used herein. The boron compounds may be included in the form of boron containing dispersants as described in U.S. Pat. No. 3,087,936 issued Apr. 30, 1963 to LeSuer.

The amount of the deposit modifier type of scavenger employed herein is that amount sufficient to lessen the deposits, or to lessen additional deposit formation. Typically, the active component in the deposit modifier is present in the composition in an equivalent ratio to the alkali metal or alkaline earth metal of about 20:1 to about 1:5, preferably about 12:1 to about 1:3.

It is also emphasized that the various forms of scavengers may be used in mixture with one another. That is, it may be desirable to, for example, clean an engine of built up deposits with a combustion modifier, or to abrade the deposits while at the same time using an organohalide to complex the salt before a deposit forms.

THE HYDROCARBON-SOLUBLE ASHLESS DISPERSANT

The fuel compositions of the present invention desirably also contain a minor amount of at least one hydrocarbon soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be quite similar.

In general, any of the ashless detergents which are known in the art for use in lubricants and fuels can be utilized in the fuel compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol or amine.

THE HYDROCARBYL-SUBSTITUTED AMINE

The hydrocarbyl-substituted amines used in the fuel compositions of this invention are well known to those of skill in the art and they are described in a number of patents. Among these are U.S. Pat. Nos. 3,275,554; 3,438,757; 3,454,555; 3,565,804; 3,755,433 and 3,822,209. These patents disclose suitable hydrocarbyl amines for use in the present invention including their method of preparation.

A typical hydrocarbyl amine has the general formula:

$$[AXN]_x[-N([-UN-]_a[-UQ]_b)]_yR^2_cH_{1+2y+ay-c} \quad \text{Formula IX}$$

wherein A is hydrogen, a hydrocarbyl group of from 1 to about 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A and N to form a ring of from 5 to 6 annular members and up to 12 carbon atoms; U is an alkylene group of from 2 to 10 carbon atoms, any necessary hydrocarbons to accommodate the trivalent nitrogens are implied herein, $R^2$ is an aliphatic hydrocarbon of from about 30 to 400 carbon atoms; Q is a piperazine structure; a is an integer of from 0 to 10; b is an interger of from 0 to 1; a+2b is an integer of from 1 to 10; c is an integer of from about 1 to 5 and is an average in the range of 1 to 4, and equal to or less than the number of nitrogen atoms in the molecule; x is an integer of from 0 to 1; y is an integer of from about 0 to 1; and x+y is equal to 1.

In interpreting this formula, it is to be understood that the $R^2$ and H atoms are attached to the unsatisfied nitrogen valences within the brackets of the formula. Thus, for example, the formula includes subgeneric formulae wherein the R is attached to terminal nitrogens and isomeric subgeneric formula wherein it is attached to non-terminal nitrogen atoms. Nitrogen atoms not attached to an $R^2$ may bear a hydrogen or an AXN substituent.

The hydrocarbyl amines useful in this invention and embraced by the above formula include monoamines of the general formula:

$$\text{Ti } AXNR^2 \quad \text{Formula X}$$

Illustrative of such monoamines are the following:

poly(propylene)amine

N,N-dimethyl-n-poly(ethylene/propylene)amine (50:50 mole ratio of monomers)

poly(isobutene)amine

N,N-di(hydroxyethyl)-N-poly(isobutene) amine poly(isobutene/1-butene/2-butene)amine (50:25:25 mole ratio of monomer)

N-(2-hydroxyethyl)-N-poly(isobutene)amine

N-(2-hydroxypropyl)-N-poly(isobutene)amine

N-poly(1-butene)-aniline

N-poly(isobutene)-morpholine

Among the hydrocarbyl amines embraced by the general Formula IX as set forth above, are polyamines of the general formula:

$$-N([-UN-]_a[-UQ]_b)R^2_cH_{1+2y+ay-c} \quad \text{Formula XI}$$

Illustrative of such polyamines are the following:

N-poly(isobutene)ethylene diamine

N-poly(propylene)trimethylene diamine

N-poly(1-butene)diethylene triamine

N',N'-poly(isobutene)tetraethylene pentamine

N,N-dimethyl-N'-poly(propylene), 1,3-propylene diamine

The hydrocarbyl substituted amines useful in the fuel compositions of this invention include certain N-aminohydrocarbyl morpholines which are not embraced in the general Formula IX above. These hydrocarbyl-substituted aminohydrocarbyl morpholines have the general formula:

$$R^2N(A)UM \quad \text{Formula XII}$$

wherein $R^2$ is an aliphatic hydrocarbon group of from about 30 to about 400 carbons, A is hydrogen, hydrocarbyl of from 1 to 10 carbon atoms or hydroxy hydrocarbyl group of from 1 to 10 carbon atoms, U is an aklkylene group of from 2 to 10 carbon atoms, and M is a morpholine structure. These hydrocarbyl-substituted aminohydrocarbyl morpholines as well as the polyamines described by Formula X are among the typical hydrocarbyl-substituted amines used in preparing compositions of this invention.

THE ACYLATED NITROGEN-CONTAINING COMPOUNDS

A number of acylated, nitrogen-containing compounds having a substituent of at least 10 aliphatic carbon atoms and made by reacting a carboxylic acid acylating agent with an amino compounds are known to those skilled in the art. In such compositions the acylating agent is linked to the amino compound through an imido, amido, amidine or acyloxy ammonium linkage. The substituent of 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in the compositions of this invention are those made by reacting an acylating agent having an aliphatic substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The aliphatic substituent in such acylating agents preferably averages at least about 30 or 50 and up to about 400 carbon atoms.

Illustrative hydrocarbon based groups containing at least ten carbon atoms are n-decyl, n-dodecyl, tetrapropenyl, n-octadecyl, oleyl, chlorooctadecyl, tri-icontanyl, etc. Generally, the hydrocarbon-based substituents are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The substituent can also be derived from the halogenated (e.g., chlorinated or brominated) analogs of such homo- or interpolymers. The substituent can, however, be made from other sources, such as monomeric high molecular weight alkenes (e.g., 1-tetra-contene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

As used in this specification and appended claims, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon group for every ten carbon atoms provided this non-hydrocarbon group does not significantly alter the predominantly hydrocarbon character of the group. Those skilled in the art will be aware of such groups, which include, for example, hydroxyl, halo (especially chloro and fluoro), alkoxy, alkyl mercapto, alkyl sulfoxy, etc. Usually, however, the hydrocarbon-based substituents are purely hydrocarbyl and contain no such non-hydrocarbyl groups.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of six or less carbon atoms for every ten carbon atoms in the substituent. Usually, however, the substituents contain no more than one such non-aliphatic group for every fifty carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following:

a mixture of poly(ethylene/propylene) groups of about 35 to about 70 carbon atoms a mixture of the oxidatively or mechanically degraded poly(ethylene/propylene) groups of about 35 to about 70 carbon atoms a mixture of poly(propylene/1-hexene) groups of about 80 to about 150 carbon atoms a mixture of poly(isobutene) groups having an average of 50 to 75 carbon atoms.

A preferred source of the substituents are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeating units) isobutene repeating units of the configuration:

$$-C(CH_3)_2CH_2-$$

Exemplary of amino compounds useful in making these acylated compounds are the following:

(1) polyalkylene polyamines of the general formula:

$$(R^3)_2N[U-N(R^3)]_nR^3 \qquad \text{Formula XIII}$$

wherein each $R^3$ is independently a hydrogen atom, a hydrocarbyl group or a hydroxy-substituted hydrocarbyl group containing up to about 30 carbon atoms, with proviso that at least one $R^3$ is a hydrogen atom, n is a whole number of 1 to 10 and U is a $C_{1-18}$ alkylene group, (2) heterocyclic-substituted polyamines including hydroxyalkyl-substituted polyamines wherein the polyamines are described above and the heterocyclic substituent is e.g., a piperazine, an imidazoline, a pyrimidine, a morpholine etc., and (3) aromatic polyamines of the general formula:

$$Ar(NR^3{}_2)_y \qquad \text{Formula XIV}$$

wherein Ar is a aromatic nucleus of 6 to about 20 carbon atoms, each R''' is as defined hereinabove and y is 2 to about 8. Specific examples of the polyalkylene polyamines (1) are ethylene diamine, tetra(ethylene)pentamine, tri-(trimethylene)tetramine, 1,2-propylene diamine, etc. Specific examples of hydroxyalkyl-substituted polyamines include N-(2-hydroxyethyl)ethylene diamine, N,N$^1$-bis(2-hydroxyethyl)ethylene diamine, N-(3-hydroxybutyl)tetramethylene diamine, etc. Specific examples of the heterocyclic-substituted polyamines (2) are N-2-aminoethyl piperazine, N-2 and N-3 amino propyl morpholine, N-3(dimethyl amino)propyl piperazine, 2-heptyl-3-(2-aminopropyl)imidazoline, 1,4-bis(2-aminoethyl)piperazine, 1-(2-hydroxy ethyl)piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763 and 4,234,435. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene chloride. In view of the extensive disclosure of this type of acylated amino compound, further discussion of their nature and method of preparation is not needed here. The above-noted U.S. Patents are utilized for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the monocarboxylic acid are formic acid, acetic acid, dodecanoic acid, butanoic acid, oleic acid, stearic acid, the commerical nature of stearic acid isomers known as isostearic acid, tolyl acid, etc. Such materials are more fully described in U.S. Pat. Nos. 3,216,936 and 3,250,715.

Still another type of acylated nitrogen compound useful in making the fuels of this invention is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12–30 carbon atoms. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are utilized for their disclosure of fatty acid/polyamine condensates for their use in lubricating oil formulations.

The Nitrogen-Containing Condensates of Phenols, Aldehydes, and Amino Compounds The phenol/aldehyde/amino compound condensates useful as dispersants in the fuel compositions of this invention include those generically referred to as Mannich condensates. Generally they are made by reacting simultaneously or sequentially at least one active hydrogen compound such as a hydrocarbon-substituted phenol (e.g., and alkyl phenol wherein the alkyl group has at least an average of about 12 to 400; preferably 30 up to about 400 carbon atoms), having at least one hydrogen atom bonded to an aromatic carbon, with at least one aldehyde or aldehyde-producing material (typically formaldehyde precursor) and at least one amino or polyamino compound having at least one NH group. The amino compounds include primary or secondary monoamines having hydrocarbon substituents of 1 to 30 carbon atoms or hydroxyl-substituted hydrocarbon substituents of 1 to about 30 carbon atoms. Another type of typical amino compund are the polyamines described during the discussion of the acylated nitrogen-containing compounds.

Exemplary mono-amines include methyl ethyl amine, methyl octadecyl amines, aniline, diethyl amine, diethanol amine, dipropyl amine and so forth. The following U.S. Patents contain extensive descriptions of Mannich condensates which can be used in making the compositions of this invention:

| U.S. PAT. NOS. | | |
|---|---|---|
| 2,459,112 | 3,413,347 | 3,558,743 |
| 2,962,442 | 3,442,808 | 3,586,629 |
| 2,984,550 | 3,448,047 | 3,591,598 |
| 3,036,003 | 3,454,497 | 3,600,372 |
| 3,166,516 | 3,459,661 | 3,634,515 |
| 3,236,770 | 3,461,172 | 3,649,229 |
| 3,355,270 | 3,493,520 | 3,697,574 |
| 3,368,972 | 3,539,633 | |

Condensates made from sulfur-containing reactants also can be used in the fuel compositions of the present invention. Such sulfur-containing condensates are described in U.S. Pat. Nos. 3,368,972; 3,649,229; 3,600,372; 3,649,659 and 3,741,869. These patents also disclose sulfur-containing Mannich condensates. Generally the condensates used in making compositions of this invention are made from a phenol bearing an alkyl substituent of about 6 to about 40 carbon atoms, more typically, 30 to about 250 carbon atoms. These typical condensates are made from formaldehyde or $C_{2-7}$ aliphatic aldehyde and an amino compound such as those used in making the acylated nitrogen-containing compounds described under (B)(ii).

These preferred condensates are prepared by reacting about one molar portion of phenolic compound with about 1 to about 2 molar portions of aldehyde and about 1 to about 5 equivalent portions of amino compound (an equivalent of amino compound is its molecular weight divided by the number of =NH groups present). The conditions under which such condensation reactions are carried out are well known to those skilled in the art as evidenced by the above-noted patents. Therefore, these patents are also incoporated by reference for their disclosures relating to reaction conditions.

A particularly preferred class of nitrogen-containing condensation products for use in the fuels of the present invention are those made by a "2-step process" as disclosed in commonly assigned U.S. Ser. No. 451,644, filed Mar. 15, 1974 now abandoned. Briefly, these nitrogen-containing condensates are made by (1) reacting at least one hydroxy aromatic compound containing an aliphatic-based or cycloaliphatic-based substituent which has at least about 30 carbon atoms and up to about 400 carbon atoms with a lower aliphatic $C_{1-7}$ aldehyde or reversible polymer thereof in the presence of an alkaline reagent, such as an alkali metal hydroxide, at a temperature up to about 150° C.; (2) substantially neutralizing the intermediate reaction mixture thus formed; and (3) reacting the neutralized intermediate with at least one compound which contains an amino group having at least one —NH— group.

More preferably, these 2-step condensates are made from (a) phenols bearing a hydrocarbon-based substituent having about 30 to about 250 carbon atoms, said substituent being derived from a polymer of propylene, 1-butene, 2-butene, or isobutene and (b) formaldehyde, or reversible polymer thereof, (e.g., trioxane, paraformaldhyde) or functional equivalent thereof, (e.g., methylol) and (c) an alkylene polyamine such as ethylene polyamines having between 2 and 10 nitrogen atoms. Further details as to this preferred class of condensates can be found in the hereinabove noted U.S. Ser. No.

451,644, which is hereby incorporated by reference, for its disclosures relating to 2-step condensates.

THE ESTERS OF SUBSTITUTED CARBOXYLIC ACIDS

The esters useful as detergents/dispersants in this invention are derivatives of substituted carboxylic acids in which the substituent is a substantially aliphatic, substantially saturated hydrocarbon-based group containing at least about 30 (preferably about 50 to about 750) aliphatic carbon atoms. As used herein, the term "hydrocarbon-based group" denotes a group having a carbon atom directly attached to the remainder of the molecule and having predominantly hydrocarbon character without the context of this invention. Such groups include the following:

(1) Hydrocarbon groups; that is, aliphatic groups, aromatic- and alicyclic-substituted aliphatic groups, and the like, of the type known to those skilled in the art.

(2) Substituted hydrocarbon groups; that is, groups containing non-hydrocarbon substituents which, in the context of this invention, do not alter the predominantly hydrocarbon character of the group. Those skilled in the art will be aware of suitable substituents; examples are halo, nitro, hydroxy, alkoxy, carbalkoxy and alkylthio.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

The substituted carboxylic acids (and derivatives thereof including esters, amides and imides) are normally prepared by the alkylation of an unsaturated acid, or a derivative thereof such as an anhydride, ester, amide or imide, with a source of the desired hydrocarbon-based group. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid and 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from about 2 to about 10 and usually from about 2 to about 6 carbon atoms, and polar substituent-containing derivatives thereof. Such polymers are substantially saturated (i.e., they contain no more than about 5% olefinic linkages) and substantially aliphatic (i.e., they contain at least about 80% and preferably at least about 95% by weight of units derived from aliphatic monoolefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; non-conjugated dienes such as 1,4-hexadiene, 1,4-cyclohexadiene, 5-ethylidene-2-norbornene and 1,6-octadiene: and trienes such as 1-isopropylidene-3a,4,7,-7a-tetrahydroindene, 1-isopropylidenedicyclopentadiene and 2-(2-methylene-4-methyl-3-pentenyl)[2.2.1]bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $c_{3-8}$ alpha-monoolefin and a polyene selected from the group consisting of non-conjugated dienes (which are especially preferred) and trienes. Illustrative of these terpolymers is "Ortholeum 2052" manufactured by E. I duPont de Nemours & Company, which is a terpolymer containing about 48 mole percent ethylene groups, 48 mole percent propylene groups and 4 mole percent 1,4-hexadiene groups and having an inherent viscosity of 1.35 (8.2 grams of polymer in 10 ml. of carbon tetrachloride at 30° C.).

Methods for the preparation of the substituted carboxylic acids and derivatives thereof are well known in the art and need not be described in detail. Reference is made, for example, to U.S. Pat. Nos. 3,272,746; 3,522,179; and 4,234,435 which are incorporated by reference herein. The mole ratio of the polymer to the unsaturated acid or derivative thereof may be equal to, greater than or less than 1, depending on the type of product desired.

The esters are those of the above-described succinic acids with hydroxy compounds which may be aliphatic compounds such as monohydric and polyhydric alcohols or aromatic compounds such as phenols and naphthols. The aromatic hydroxy compounds from which the esters of this invention may be derived are illustrated by the following specific examples: phenol, beta-naphthol, alpha-naphthol, cresol, resorcinol, catechol, p,p'dihydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000)-substituted phenol, the condensation product of heptylphenol with 0.5 mole of formaldehyde, the condensation product of octylphenol with acetone, di(hydroxyphenyl)-oxide, di(hydroxyphenyl)sulfide, di(hydroxyphenyl)disulfide, and 4-cyclohexylphenol. Phenol and alkylated phenols having up to three alkyl substituents are preferred. Each of the alkyl substituents may contain 100 or more carbon atoms.

The alcohols from which the esters may be derived preferably contain up to about 40 aliphatic carbon atoms. They may be monohydric alcohols such as methanols, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, secpentyl alcohol, tertbutyl alcohol, 5-bromo-dodecanol, nitro-octadecanol and dioleate of glycerol. The polyhydric alcohols preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, penacol, erythritol, arabitol, sorbitol, mannitol, 1,2-cyclo-hexanediol, and xylene glycol. Carbohydrates such as sugars, starches, cellulose, etc., likewise may yield the esters of this invention. The carbohydrates may be exemplified by a glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms, such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, an oleyl alcohol. Still another class of the alcohols capable of yielding the esters of this invention comprise the ether-alcohols and amino-alcohols including, for example, the oxyalkylene-, oxyarylene-, amino-alkylene-, and amino-arylene-substituted alcohols having one or more oxy-alkylene, amino-alkylene or amino-arylene oxy-arylene radicals. They are exemplified by Cellosolve, carbitol, phenoxyethanol, heptylphenyl-(oxypropylene)$_6$-H, octyl-(oxyethylene)$_{30}$-H, phenyl-(oxyoctylene)$_2$-H, mono(heptylphenyloxypropylene)-substituted glycerol, poly(styrene oxide), amino-ethanol, 3-amino ethyl-pentanol, di(hydroxyethyl)amine, p-amino-phenol, tri(hydroxypropyl-)amine, N-hydroxyethyl ethylene diamine, N,N,N',N'-tetrahydroxytrimethylene diamine, and the like. For the most part, the ether-alcohols having up to about 150 oxyalkylene radicals in which the alkylene radical contains from 1 to about 8 carbon atoms are preferred.

The esters may be di-esters of succinic acids or acidic esters, i.e., partially esterified polyhydric alcohols or phenols, i.e., esters having free alcoholic or phenolic hydroxyl radicals. Mixtures of the above-illustrated esters likewise are contemplated within the scope of the invention.

The esters may be prepared by one of several methods. The method which is preferred because of convenience and superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C.

The water formed as a by-product is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene, and mineral oil.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid radicals is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl radicals of the alcohol is esterified with one of the two acid radicals of the succinic acid. Thus, the maximum proportion of the succinic acid to be used with a polyhydric alcohol is determined by the number of hydroxyl groups present in the molecule of the hydroxy reactant. For the purposes of this invention, it has been found tha esters obtained by the reaction of equimolar amounts of the succinic acid reactant and hydroxy reactant have superior properties and are therefore preferred.

In some instances, it is advantageous to carry out the esterification in the presence of a catalyst such as sulfuric acid, pyridine hydrochloride, hydrochloric acid, benzenesulfonic acid, p-toluenesulfonic acid, phosphoric acid, or any other known esterification catalyst. The amount of the catalyst in the reaction may be as little as 0.01% (by weight of the reaction mixture), more often from about 0.1% to about 5%.

The esters of this invention likewise may be obtained by the reaction of a substituted succinic acid or anhydride with an epoxide or a mixture of a epoxide and water. Such reaction is similar to one involving the acid or anhydride with a glycol. For instance, the product may be prepared by the reaction of a substituted succinic acid with one mole of ethylene oxide. Similarly, the product may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soya bean oil, methyl ester of 9,10-epoxy-stearic acid, and butadiene mono-epoxide. For the most part, the epoxides are the alkylene oxides in which the alkylene radical has from 2 to about 8 carbon atoms; or the epoxidized fatty acid esters in which the fatty acid radical has up to about 30 carbon atoms and the ester radical is derived from a lower alcohol having up to about 8 carbon atoms.

In lieu of the succinic acid or anhydride, a lactone acid or a substituted succinic acid halide may be used in the processes illustrated above for preparing the esters of this invention. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorous tribromide, phosphorus pentechloride, or thionyl chloride. These and other methods of preparing the succinic compounds are well known in the art and need not be illustrated in further detail here.

Still other methods of preparing the esters useful in the fuels of this invention are available. For instance, the esters may be obtained by the reaction of maleic acid or anhydride with an alcohol such as is illustrated above to form a mono- or di-ester of maleic acid and then the reaction of this ester with an olefin or a chlorinated hydrocarbon such as is illustrated above. They may also be obtained by first esterifying itaconic anhydride or acid and subsequently reacting the ester intermediate with an olefin or a chlorinated hydrocarbon under conditions similar to those described hereinabove.

THE POLYMERIC DISPERSANTS

A large number of different types of polymeric dispersants have been suggested as useful in lubricating oil formulations, and such polymeric dispersants are useful in the fuel compositions of the present invention. Often, such additives have been described as being useful in lubricating formulations as viscosity index improvers with dispersing characteristics. The polymeric dispersants generally are polymers or copolymers having a long carbon chain and containing "polar" compounds to impart the dispersancy characteristics. Polar groups which may be included include amines, amides, imines, imides, hydroxyl, ether, etc. For example, the polymeric dispersants may be copolymers of methacrylates or acrylates containing additional polar groups, ethylenepropylene copolymers containing polar groups or vinyl acetatefumaric acid ester copolymers.

Many such polymeric dispersants have been described in the prior art, and it is not believed necessary to list in detail the various types. The following are examples of patents describing polymeric dispersants. U.S. Pat. No. 4,402,844 describes nitrogen-containing copolymers prepared by the reaction of lithiated hydrogenated conjugated dienemonovinylarene copolymers with substituted aminolactans. U.S. Pat. No. 3,356,763 describes a process for producing block copolymers of dienes such as 1,3-butadiene and vinyl aromatic hydrocarbons such as ethyl styrenes. U.S. Pat. No. 3,891,721 describes block polymers of styrenebutadiene-2-vinyl pyridine.

A number of the polymeric dispersants may be prepared by the grafting polar monomers to polyolefinic backbones. For example, U.S. Pat. Nos. 3,687,849 and 3,687,905 describe the use of maleic anhydrides as a graft monomer to a polyolefinic backbone. Maleic acid or anhydride is particularly desirable as a graft monomer because this monomer is relatively inexpensive, provides an economical route to the incorporation of dispersant nitrogen compounds into polymers by further reaction of the carboxyl groups of the maleic acid or anhydride with, for example, nitrogen compounds or hydroxy compounds. U.S. Pat. No. 4,160,739 describes graft copolymers obtained by the grafting of a monomer system comprising maleic acid or anhydride and at least one other different monomer which is addition copolymerizable therewith, the grafted monomer system then being post-reacted with a polyamine. The monomers which are copolymerizable with maleic acid or anhydride are any alpha, beta-monoethylenically unsaturated monomers which are sufficiently soluble in the reaction medium and reactive towards maleic acid or anhydride so that substantially larger amounts of maleic acid or anhydride can be incorporated into the grafted polymeric product. Accordingly, suitable monomers include the esters, amides and nitriles of acrylic and methacrylic acid, and monomers containing no free acid groups. The inclusion of heterocyclic monomers into graft polymers is described by a process which comprises a first step of graft polymerizing an alkyl ester of acrylic acid or methacrylic acid, alone or an combination with styrene, onto a backbone copolymer which is a hydrogenated block copolymer of styrene and a conjugated diene having 4 to 6 carbon atoms to form a first graft polymer. In the second step, a polymerizable heterocyclic monomer, alone or in combination with a hydrophobizing vinyl ester is co-polymerized onto the first graft copolymer to form a second graft copolymer.

Other patents describing graft polymers useful as dispersants in the fuels of this invention include U.S. Pat. Nos. 3,243,481; 3,475,514; 3,723,575; 4,026,167; 4,085,055; 4,181,618; and 4,476,283.

Another class of polymeric dispersant useful in the fuel compositions of the invention are the so-called "star" polymers and copolymers. Such polymers are described in, for example, U.S. Pat. Nos. 4,347,193, 4,141,847, 4,358,565, 4,409,120 and 4,077,893. All of the above patents relating to polymeric dispersants are utilized for their disclosure of suitable polymeric dispersants which can be utilized in the fuels of this invention.

THE HYDROCARBON-SUBSTITUTED PHENOLIC DISPERSANT

The hydrocarbon-substituted phenolic dispersants useful in the fuel compositions of the present invention include the hydrocarbon-substituted phenolic compounds wherein the hydrocarbon substituents have a molecular weight which is sufficient to render the phenolic compound fuel soluble. Generally, the hydrocarbon substituent will be a substantially saturated, hydrocarbon-based group of at least about 30 carbon atoms. The phenolic compounds may be represented generally by the following formula:

$$(R)_a\text{—Ar—}(OH)_b \qquad \text{Formula XV}$$

wherein R is a substantially saturated hydrocarbon-based substituent having an average of from about 30 to about 400 aliphatic carbon atoms, and a and b are each, 1, 2 or 3. Ar is an aromatic moiety such as a benzene nucleus naphthalene nucleus or linked benzene nuclei. Optionally, the above phenates as represented by Formula XV may contain other substituents such as lower alkyl groups, lower alkoxy, nitro, amino, and halo groups. Preferred examples of optional substituents are the nitro and amino groups.

The substantially saturated hydrocarbon-based group R in Formula XV may contain up to about 750 aliphatic carbon atoms although it usually has a maximum of an average of about 400 carbon atoms. In some instances R has a minimum of about 50 carbon atoms. As noted, the phenolic compounds may contain more than one R group for each aromatic nucleus in the aromatic moiety Ar.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such homo- or interpolymers. The R groups can, however, be made from other sources, such as monomeric high molecular weight alkenes (e.g. 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the R groups may be reduced or eliminated by hydrogenation according to procedures known in the art before the nitration step described hereafter.

Specific examples of the substantially saturated hydrocarbon-based R groups are the following:

- a tetracontanyl group
- a henpentacontanyl group
- a mixture of poly(ethylene/propylene) groups of about 35 to about 70 carbon atoms
- a mixture of the oxidatively or mechanically degraded poly-(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms.

A preferred source of the group R are poly-(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoide. These polybutenes contain predominantly (greater than 80% of total repeat units) isobutene repeating units of the configuration.

$$-C(CH_3)_2CH_2-$$

The attachment of the hydrocarbon-based group R to the aromatic moiety Ar of the amino phenols of this invention can be accomplished by a number of techniques well known to those skilled in the art.

In one preferred embodiment, the phenolic dispersants useful in the fuels of the present invention are hydrocarbon-substituted nitro phenols as represented by Formula XV wherein the optional substituent is one or more nitro groups. The nitro phenols can be conveniently prepared by nitrating appropriate phenols, and typically, the nitro phenols are formed by nitration of alkyl phenols having an alkyl group of at least about 30 and preferably about 50 carbon atoms. The preparation of a number of hydrocarbon-substituted nitro phenols useful in the fuels of the present invention is described in U.S. Pat. No. 4,347,148.

In another preferred embodiment, the hydrocarbon-substituted phenol dispersants useful in the present invention are hydrocarbon-substituted amino phenols such as represented by Formula XV wherein the optional substituent is one or more amino groups. These amino phenols can conveniently be prepared by nitrating an appropriate hydroxy aromatic compound as described above and there after reducing the nitro groups to amino groups. Typically, the useful amino phenols are formed by nitration and reduction of alkyl phenols having an alkyl or alkenyl group of at least about 30 and preferably about 50 carbon atoms. The preparation of a large number of hydrocarbon-substituted amino phenols useful as dispersants in the present invention is described in U.S. Pat. No. 4,320,021.

THE FUEL-SOLUBLE ALKOXYLATED DERIVATIVES OF ALCOHOLS, PHENOLS OR AMINES

Also useful as dispersants in the fuel compositions of the present invention are fuel-soluble alkoxylated derivatives of alcohols, phenols and amines. A wide variety of such derivatives can be utilized as long as the derivatives are fuel-soluble. More preferably, the derivatives in addition to being fuel-soluble should be water-insoluble. Accordingly, in a preferred embodiment, the fuel-soluble alkoxylated derivatives useful as the dispersants are characterized as having an HLB of from 1 to about 13.

As is well known to those skilled in the art, the fuel-solubility and water-insolubility characteristics of the alkoxylated derivatives can be controlled by selection of the alcohol or phenols and amines, selection of the particular alkoxy reactant, and by selection of the amount of alkoxy reactant which is reacted with the alcohols, phenols and amines. Accordingly, the alcohols which are utilized to prepare the alkoxylated derivatives are hydrocarbon based alcohols while the amines are hydrocarbyl-substituted amines such as, for example, the hydrocarbyl-substituted amines described above as dispersant (B) (i). The phenols may be phenols or hydrocarbon-substituted phenols and the hydrocarbon substituent may contain as few as 1 carbon atom.

The alkoxylated derivatives are obtained by reacting the alcohol, phenol or amine with an epoxide or a mixture of an epoxide and water. For example, the derivative may be prepared by the reaction of the alcohol, phenol or amine with an equal molar amount or an excess of ethylene oxide. Other epoxides which can be reacted with the alcohol, phenol or amine include, for example, propylene oxide, styrene oxide, 1,2-butylene oxide, 2,3-butylene oxide, epichlorohydrin, cyclohexane oxide, 1,2-octylene oxide, etc. Preferably, the epoxides are the alkylene oxides in which the alkylene group has from about 2 to about 8 carbon atoms. As mentioned above, it is desirable and preferred that the amount of alkylene oxide reacted with the alcohol, phenol or amine be insufficient to render the derivative water-soluble.

The following are examples of commercially available alkylene oxide derivatives which may be utilized as dispersants in the fuel compositions of the present invention: Ethomeen S/12, tertiary amines ethylene oxide condensation products of the primary fatty amines (HLB, 4.15; Armak Industries); Plurafac A-24, an oxyethylated straight-chain alcohol available from BASF Wyandotte Industries (HLB 5.0); etc. Other suitable fuel-soluble alkoxylated derivatives of alcohols, phenols and amines will be readily apparent to those skilled in the art.

The following specific examples illustrate the preparation of exemplary dispersants useful in the fuel compositions of this invention.

EXAMPLE B-1

A mixture of 1500 parts of chlorinated poly(isobutene) having a molecular weight of about 950 and a chlorine content of 5.6%, 285 parts of an alkylene polyamine having an average composition corresponding stoichiometrically to tetraethylene pentamine and 1200 parts of benzene is heated to reflux. The temperature of the mixture is then slowly increased over a 4-hour period to 170° C. while benzene is removed. The cooled mixture is diluted with an equal volume of mixed hexanes and absolute ethanol (1:1). The mixture is heated to reflux and ⅓ volume of 10% aqueous sodium carbonate is added to the mixture. After stirring, the mixture is allowed to cool and phase separate. The organic phase is washed with water and stripped to provide the desired polyisobutenyl poly-amine having a nitrogen content of 4.5% by weight.

EXAMPLE B-2

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7% by weight.

EXAMPLE B-3

To 1,133 parts of commercial diethylene triamine heated to 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blow with nitrogen to remove volatiles. The mixture is held at 205°-230° C. for a total of 11.5 hours and the stripped at 230° C./20 torr (2.65 KPa) to provide the desired acylated polyamine as residue containing 6.2% nitrogen by weight.

EXAMPLE B-4

To a mixture of 50 parts of a polypropyl-substituted phenol (having a molecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 37% aqueous solution of formaldehyde (corresponding to 8 parts aldehyde). During the addition, the reaction temperature is slowly increased to 100° C. and held at that point for three hours while the mixture is blown with nitrogen. To the cooled reaction mixture is added 100 parts toluene and 50 parts mixed butyl alcohols. The organic phase is washed three times with water until neutral to litmus paper and the organic phase filtered and stripped to 200° C./5-10 (0.66-1.33 KPa) torr. The residue is an oil solution of the final product containing 0.45% nitrogen by weight.

EXAMPLE B-5

A mixture of 140 parts of a mineral oil, 174 parts of a poly(isobutene)-substituted succinic anhydride (molecular weight 1000) having a saponification number of 105 and 23 parts of isostearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. with nitrogen at a rate of 5 pounds (2.27 Kg) per hour for 3 hours whereupon 47 parts of an aqueous distillate is obtained. The mixture is dried at 225° C. for 1 hour, cooled to 100° C. and filtered to provide the desired final product in oil solution.

EXAMPLE B-6

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm (4 KPa) for 12 hours. The residue is a mixture of the esters resulting from the esterification of one and both hydroxy radicals of the glycol. It has a saponification number of 101 and an alcoholic hydroxyl content of 0.2% by weight.

EXAMPLE B-7

The dimethyl ester of the substantially hydrocarbon-substituted succinic anhydride of Example B-2 is prepared by heating of mixture of 2185 grams of the anhydride, 480 grams of methanol, and 1000 cc. of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm (8 KPa) to rid it of volatile components. The residue is the defined dimethyl ester.

EXAMPLE B-8

A carboxylic acid ester is prepared by slowly adding 3240 parts of a high molecular weight carboxylic acid (prepared by reacting chlorinated polyisobutylene and acrylic acid in a 1:1 equivalent ratio and having an average molecular weight of 982) to a mixture of 200 parts of sorbitol and 100 parts of diluent oil over 1.5-hour period while maintaining a temperature of 115°-125° C. Then 400 parts of additional diluent oil are added and the mixture is maintained at about 195°-205° C. for 16 hours while blowing the mixture with nitrogen. An additional 755 parts of oil are then added, the mixture cooled to 140° C., and filtered. The filtrate is an oil solution of the desired ester.

EXAMPLE B-9

An ester is prepared by heating 658 parts of a carboxylic acid having an average molecular weight of 1018

(prepared by reacting chlorinated polyisobutene with acrylic acid) with 22 parts of pentaerythritol while maintaining a temperature of about 180°-205° C. for about 18 hours during which time nitrogen is blown through the mixture. The mixture is then filtered and the filtrate is the desired ester.

EXAMPLE B-10

To a mixture comprising 408 parts of pentaerythritol and 1100 parts oil heated to 120° C., there is slowly added 2946 parts of the acid of Example B-9 which has been preheated to 120° C., 225 parts of xylene, and 95 parts of diethylene glycol dimethylether. The resulting mixture is heated at 195°-205° C., under a nitrogen atmosphere and reflux conditions for eleven hours, stripped to 140° C. at 22 mm (2.92 KPa) (Hg) pressure, and filtered. The filtrate comprises the desired ester. It is diluted to a total oil content of 40%.

As mentioned above, the fuel compositions of the present invention comprise a major amount of liquid hydrocarbon fuel and a minor amount of the combination of (A) at least one hydrocarbon soluble alkali or alkaline earth metal-containing composition as described above and (B) a scavenger as previously described.

The present invention is particularly relevant to fuel compositions which are unleaded or low-lead gasolines. For the purposes of the present specification and claims, the term "unleaded" is used to indicate that no lead compounds such as tetraethyl lead or tetramethyl lead have been added intentionally to the fuel. The term "low-lead" indicates that the fuel contains less than about 0.5 gram of lead per gallon of fuel. The present invention is particularly useful for low-lead fuel compositions containing as little as 0.1 gram of lead per gallon (0.0264 g/liter) of fuel.

The amount of the hydrocarbon soluble alkali or alkaline earth metal-containing composition (A) included in the fuel compositions of the present invention may vary over a wide range although it is preferred not to include unnecessarily large excesses of the metal composition. The amount included in the fuel should be an amount sufficient to improve the desired properties such as the reduction of valve seat recession when the fuel is burned in internal combustion engines which are not designed for use with unleaded gas. For example, older engines which were designed for leaded fuels were not constructed with specially hardened valve seats. Accordingly, the amount of metal composition to be included in the fuel will depend in part on the amount of lead in the fuel. For unleaded fuels, large amounts of the metal composition are required to provide the desirable reduction in valve seat recession. When low-lead fuels are treated in accordance with the present invention, lesser amounts of the metal-containing composition generally are required.

In summary, the amount of component (A) included in the fuel compositions of the present invention will be an amount which is sufficient to reduce valve seat recession when such fuels are utilized in an internal combustion engine. Generally, the fuel will contain less than about 0.2 gram preferably, less than 0.1 gram of the alkali or alkaline earth metal compound per liter of fuel. In another embodiment, the fuel composition of the present invention will contain from about 1 to about 100 parts of the alkali metal or alkaline earth metal per million parts of fuel although amounts of from 10 to about 60 parts per million appear to be adequate for most applications. The weight ratio of the alkali metal or alkaline earth metal containing composition to the scavenger is typically from about 5:1 to about 1:25, preferably about 3:1 to about 1:15.

The amount of the hydrocarbon-soluble ashless dispersant optionally included in the fuel compositions of this invention also can vary over a wide range, and the amount will depend in part on the amount of the metal-containing composition (A) to ashless dispersant can range from about 4:0.1 to about 1:4. The amount of the ashless dispersant to be included in the particular fuel composition can be determined readily by one skilled in the art and, obviously, the amount of dispersant contained in the fuel should not be so high as to have deleterious effects such as forming deposits on engine parts when the engine is cooled. Generally, fuels will be prepared to contain from about 50 to about 500 parts, and more preferably from about 80 to 400 parts by weight of the dispersant per million parts by weight of fuel.

The fuel compositions of the present invention can be prepared either by adding the individual components to a liquid hydrocarbon fuel, or a concentrate can be prepared comprising the components either neat or in a hydrocarbon diluent such as a mineral oil. Preferably, the diluent has a flash point in the range where the product facilitates combustion in the engine. When a concentrate is prepared, the relative amounts of the components included in the concentrate will correspond essentially to the relative amounts desired in the fuel composition. The products obtained herein have a high degree of water stability, e.g., the inorganic cations are not particularly leached out of the product on contact with water.

The following examples illustrate the concentrates and fuel compositions in accordance with the present invention.

| | Parts by Weight |
|---|---|
| Example 1 (Concentrate) | |
| The neutral sodium sulfonate of Example A-1 | 200 |
| The dispersant of Example B-1 | 75 |
| Mineral oil | 75 |
| Example 2 (Concentrate) | |
| The neutral sodium salt of Example A-1 | 100 |
| The dispersant of Example B-5 | 25 |
| Mineral oil | 25 |
| Example 3 (Concentrate) | |
| The neutral sodium sulfonate of Example A-1 | 168 |
| The dispersant of Example B-2 | 42 |
| Heavy Oil | 40 |
| Mineral Oil | 200 |
| Example 4 (Concentrate) | |
| The neutral sodium sulfonate of Example A-1 | 336 |
| The dispersant of Example B-2 | 84 |
| Heavy Oil | 80 |

EXAMPLE 5 (Concentrate)

Unleaded gasoline is treated with the concentrate of Example 2 at a treatment level of about 500 lbs. per 1000 barrels of fuel.

EXAMPLE 6

An engine is stabilized using idolene clear fuel. After stabilization 1000 PTB of the additive of Example 1 is introduced to the engine. A magnesium dialkyl benzene sulfonate is also present in the fuel at a level of one atom of magnesium per two atoms of sodium. Valve protection is observed through utilizing a mixture of the alkali metal and alkaline earth metal salts.

In addition to the additives of this invention, the use of other conventional fuel additives is contemplated. Thus, the fuel compositions may also contain surface-ignition suppressants, dyes, gum inhibitors, oxidation inhibitors, etc.

The present invention is directed generally to fuel compositions, but in particular to low-lead or unleaded gasoline compositions containing an alkali metal or alkaline earth metal composition, an ashless dispersant and a scavenger. While fuels containing the additives of the present invention preferably are low-lead or unleaded gasolines are burned in internal combustion engines, the fuel compositions of the present invention also are useful in lowering hydrocarbon emissions from the exhaust, producing improved combustion chamber and valve cleanliness, reducing varnish on pistons, reducing carburetor throat deposits and decreasing sludge and varnish in crankcase parts and valve covers.

EXAMPLE 7

The concentrate of Example 3 is added at 250 PTB (0.72 g/liter) to indolene (standard reference fuel). The fuel also contains lead at 0.1 gram/gallon (0.026 g/liter) as tetraethyl lead.

No appreciable octane requirement increase (ORI) is observed after 170 hours of operation. The engine was originally stabilized for 108 hours utilizing a mixture of the fuel and lead without the concentrate of Example 2 being present.

The purpose of the foregoing experiment is to show that the additive concentrate of example 3 does not unduly increase the octane requirement of the engine when added to the low-lead fuel at levels sufficient to protect the exhaust valve seats.

EXAMPLE 8

An engine having an initial octane requirement of 84 is fueled with indolene clear and run for 144 hours. The octane requirement at 144 hours increases five units due to stabilization of the engine. At the 144 hour mark the fuel is switched to indolene clear containing 250 PTB of the concentrate of Example 3. The engine is then run for a total of 252 hours and a two unit gain in ORI is observed.

This example shows the effect of stabilizing an engine designed to run on a leaded fuel which during the stabilization period contains an unleaded fuel. The valve protecting effect of the concentrate in the absence of any scavenger is also obtained. While the effect of the concentrate (Example 3) is a minimal on the ORI, it may be unacceptable in some engines due to the stabilization effect after running the engine for the first 144 hours. Thus the need to reduce the overall ORI is observed in this example.

EXAMPLE 9

An engine is stabilized as in Example 8 over a period of 140 hours. The fuel utilized in this example is also indolene clear. The additive concentrate of Example 3 at 250 PTB is added following stabilization of the engine. The fuel following stabilization, contains a mixture of ethylene dibromide and ethylene dichloride as a scavenger. The amount of ethylene dibromide (EDB) utilized is at a molar ratio of one atom of bromide from the (EDB) per two atoms of sodium. The ethylene chloride (EDC) level is one molecule of chlorine from the (EDC) per one molecule of sodium.

There is no observed ORI after a period of 240 hours of operation of the engine. This example shown that when using a scavenger that the ORI is not further increased by use of the additive concentrate of Example 3.

EXAMPLE 10

An engine is stabilized on indolene clear fuel for a period of 110 hours. The engine is then restarted utilizing a valve treatment preparation according to Example 4 at 1000 PTB (32 ppm sodium). The fuel also contains ethylene dibromide and ehtylene dichloride at a level of bromine and chlorine to sodium per Example 9.

This example shows the benefits of protecting the valves at an increased level of the additive concentrate. The rise in ORI at 320 hours is equivalent to that of the 110 hour stabilization period.

EXAMPLE 11

An indolene clear fuel sample is used to stabilize an engine over a period of 145 hours. At the 145 hour point 1000 PTB (32 ppm sodium) of the concentrate of Example 4 is added to the fuel and the test continued. Also present in the fuel after the 145 hour stabilization period is 15 ppm of copper as a Mannich base. The engine test is then continued for a period of up to 350 hours.

The engine is dismantled and the deposit formation within the engine is observed. While some deposits have formed within the engine over the 350 hour period there is no evidence of jagged or dendritic deposits. The absence of dendritic deposits indicates that the fuel is not subject to abnormal preignition. Satisfactory valve seat protection is obtained.

EXAMPLE 12

An engine is run on indolene clear fuel and stabilized over a period of 210 hours. At the 210 hour point 1000 PTB of the concentrate in Example 4 is utilized in the fuel. Cerium is also present in the form of its octoate salt at a concentration of 15 ppm of cerium. The product performs to reduce valve seat recession. The ORI increase observed between 210 and 396 hours of operation is less than during the initial stabilization period.

EXAMPLE 13

This example utilizes an engine which is stabilized on an indolene clear fuel over a period of 96 hours. At the 96 hour point the fuel is adjusted to contain the concentrate of Example 4 at 1000 PTB. Also present in the fuel mix is manganese in the form of its carboxylate. The manganese content as manganese is 15 ppm.

This example shows the benefit of utilizing manganese to reduce the formation of ionic-carbonaceous deposits within the engine. The ORI increase between 96 hours (initial stabilization time) and 240 hours when the test is terminated is only slightly greater than during the initial stabilization period. Acceptable valve seat protection is also obtained.

EXAMPLE 14

An indolene clear fuel is stabilized over a period of 96 hours. After 96 hours the additive concentrate of Example 4 is introduced to the fuel at 1000 PTB. The engine is then restarted and the test allowed to proceed for a total time of 310 hours.

This example shows that in the absence of any form of a scavenger that the ORI increase total (stabilization+post-additive) is greater than those examples containing a combustion modifier (scavenger) or a conventional lead scavenger. Acceptable valve seat protection is obtained in this Example.

EXAMPLE 15

An indolene clear fuel sample is used to stabilize an engine. After the engine has been stabilized the concentrate of Example 4 at 1000 PTB is added to the fuel. A further ingredient in the fuel is aluminum in the form of its triisopropyl adduct combined with 2-ethylhexyl alcohol (1:2 molar ratio respectively). Also present is Ethomeen C-12 at a 1:1 molar ratio to the isopropyl alcohol. The aluminium is utilized at one mole of aluminum per mole of sodium from the concentrate. The engine is then restabilized with the concentrate and the source of aluminium present in the fuel. The engine is then taken apart and graded for deposit formation. Acceptable deposit formation is found with adequate valve seat recession protection.

EXAMPLE 16

An indolene clear fuel is obtained and utilized to stabilize an engine over a period of 140 hours. At the 140 hour point the fuel is treated so that it contains 1000 PTB of the concentrate of Example 4 which is modified by fully incorporating boron into the dispersant. Acceptable valve seat recession protection is obtained without undue deposit formation in the cylinder.

EXAMPLE 17

A source of indolene clear fuel is obtained as in the preceding examples and the engine stabilized over a period of 120 hours. Following the 120 hour stabilization period for which the ORI is noted, 1000 PTB of the concentrate of Example 4 and iron in the form of its carboxylate is introduced to the fuels. The concentration of the iron within the fuel is 15 ppm. The ORI increase after stabilization is only slightly greater than the initial increase during stabilization.

EXAMPLE 18

An indolene clear fuel sample is obtained as in the preceding examples. An engine is stabilized to obtain the initial ORI increase from the use of the fuel. The fuel is then treated with 250 PTB (8 ppm of sodium) of the concentrate of Example 3. The fuel is also treated with ethylene dichloride at the chlorine to sodium ratio given in Example 9. The engine is restabilized and the ORI determined. The ORI is acceptable and the adequate valve seat protection is obtained.

EXAMPLE 19

A fuel is obtained as in the preceding example. After the initial of stabilization to determine the ORI requirement, the fuel supply is changed to incorporate silicon as a silicone fluid. The silicon is added to the fuel at a ratio of one mole of silicon per two moles of sodium.

At the end of the test period the ORI is again determined and the engine is observed for valve seat recession. Both the valve seat recession and the ORI increase are acceptable.

EXAMPLE 20

An indolene clear fuel is obtained as in the preceeding examples. The engine is tested until stabilization is achieved with regard to ORI. Following stabilization, the fuel is changed to include 250 PTB of the additive of Example 3. In addition to the additive of Example 3 the fuel also contains on a one to one molar basis one part of lithium per part of sodium. The lithium is incorporated in the formulation as its alkylbenzene sulfonate.

The engine is then restarted and the stabilization with regard to ORI is again achieved. The engine is then dismantled and the valve seats inspected for wear. This product is acceptable both in regard to ORI and valve seat recession.

EXAMPLE 21

An indolene clear fuel sample is obtained and the engine is stabilized in regard to ORI. The fuel at that time is modified to include the concentrate of Example 3 at 250 PTB. The fuel is further modified to contain titanium in the form of its isopropoxide with a mixture of C9-11 alcohols and 2,4-pentene dione in a 1:1:1 molar ratio. The titanium is present in a 1:1 ratio to the sodium.

The engine is then restarted using the modified fuel and again allowed to stabilize with regard to ORI. At the end of the test the ORI is measured and the engine is taken apart and examined for deposits and valve seat recession. Acceptable ORI and wear results are obtained.

EXAMPLE 22

An indolene clear fuel is used in an engine as in the preceding examples. After stabilization the fuel has the concentrate of Example 4 added at 250 PTB. The fuel also contains titanium at 15 ppm. The titanium is present as the isopropoxide (A) with 2,4 pentadione (B) and a mixture of undecyl and nonyl alcohol (C) with A:B:C as a molar ratio of 1:1:1.

The engine is then restarted using the modified fuel and again allowed to stabilize with regard to ORI. At the end of the test the ORI is measured and the engine is taken apart and examined for deposits and valve seat recession. Acceptable ORI and wear results are obtained.

EXAMPLE 23

A fuel is obtained as in Example 20. The engine is stabilized and the fuel is then modified to contain molybdenum at 15 ppm as ammoniumdimolybdate in xylene with a surfactant Ethomeen 0-12 included. The molybdenum package contains 11.9% molybdenum by weight. The fuel also contains the concentrate of Example 4 at 1000 PTB. Acceptable valve seat recession and ORI are observed.

What is claimed is:

1. An unleaded fuel composition for an internal combustion engine comprising a major portion of a liquid hydrocarbon fuel and a minor amount of:

(a) a hydrocarbon soluble alkali metal or alkaline earth metal containing composition; and (b) a lead scavenger.

2. The fuel composition of claim 1 wherein the fuel contains less than about 0.2 grams of alkali or alkaline earth metal containing composition per liter of fuel.

3. The fuel composition of claim 1 wherein (a) is an alkali metal or alkaline earth metal salt of a sulfur acid, a phosphorus acid, a carboxylic acid or a phenol.

4. The fuel composition of claim 3 wherein (a) is a neutral or basic salt of an organic sulfonic acid.

5. The fuel composition of claim 1 additionally containing a hydrocarbon-soluble ashless dispersant.

6. The fuel composition of claim 1 containing about 1 to about 100 parts per million of the alkali metal.

7. The fuel composition of claim 5 wherein the dispersant is at least one acylated, nitrogen-containing compound having a substituent of at least about 10 aliphatic carbon atoms, made by reacting a carboxylic acid acylating agent with at least one amino compound containing at least one

—NH— group, said acylating agent being linked to said amino compound through an imido, amido, amidine or acyloxy ammonium linkage.

8. The fuel composition of claim 4 wherein (a) is a neutral salt of an organic sulfonic acid.

9. The fuel composition of claim 8 wherein the sulfonic acid salt is an alkali metal sulfonate in an amount sufficient to reduce valve seat recession in an internal combustion engine.

10. The fuel composition of claim 4 wherein the sulfonic acid is an alkylated benzene sulfonic acid or alkylated naphthalene sulfonic acid or mixtures thereof.

11. The fuel composition of claim 7 wherein the amino compound is an alkylene polyamine of the general formula:

$$(R^3)_2[—U—N(R^3)]_nR^3$$

wherein U is an alkylene group of about 1 to about 18 carbon atoms, each $R^3$ is independently a hydrogen atom, a hydrocarbyl group or a hydroxy-substituted hydrocarbyl group containing up to about 30 carbon atoms, with the proviso that at least one $R^3$ is a hydrogen atom, and n is 1 to about 10.

12. The fuel composition of claim 1 wherein the lead scavenger is present in an amount sufficient to reduce the amount of alkali metal or alkaline earth metal deposits within the internal combustion engine cylinders.

13. The fuel composition of claim 5 wherein the weight ratio of the hydrocarbon soluble alkali metal or alkaline earth metal containing composition to the hydrocarbon soluble ashless dispersant is about 4:0.1 to about 1:4.

14. The fuel composition of claim 1 wherein the equivalent ratio of the alkali or alkaline earth metal to the lead scavenger is about 2:1 to about 1:15.

15. The fuel composition of claim 1 wherein the lead scavenger is a halogenated hydrocarbon.

16. The fuel composition of claim 1 wherein the lead scavenger is selected from the group consisting of a 1,4-ditertiary-alkylbenzene, carbamates and mixtures thereof.

17. The fuel composition of claim 15 wherein the halogenated hydrocarbon is selected from the group consisting of dichloroethane, trichloromethane, tribrimomethane, and dibromoethane and mixtures thereof.

18. The fuel composition of claim 17 containing as the lead scavenger dibromoethane and dichloroethane in a respective weight ratio of about 10:1 to about 1:10.

19. A fuel composition for internal combustion engines comprising a major amount of a liquid hydrocarbon fuel and a minor amount of (a) a hydrocarbon-soluble alkali or alkaline earth metal containing composition and (b) a hydrocarbon-soluble member selected from the group consisting of aluminum containing compositions, silicon containing compositions, molybdenum containing compositions, lithium containing compositions, calcium containing compositions, magnesium containing compositions and mixtures thereof.

20. The fuel composition of claim 19 containing less than 0.5 gram of lead per liter of fuel.

21. The fuel composition of claim 19 wherein the fuel contains less than about 0.2 grams of alkali metal or alkaline earth metal containing composition per liter of fuel.

22. The fuel composition of claim 19 containing about 1 to 100 parts per million of alkali metal.

23. The fuel composition of claim 19 wherein (a) is an alkali metal or alkaline earth metal salt of a sulfur acid, a phosphorus acid, a carboxylic acid or a phenol.

24. The fuel composition of claim 23 wherein (a) is a neutral or basic salt of an organic sulfonic acid.

25. The fuel composition of claim 23 wherein the metal is sodium.

26. The fuel composition of claim 23 wherein (a) is the neutral salt of an organic sulfonic acid.

27. The fuel composition of claim 19 additionally containing a hydrocarbon-soluble ashless dispersant.

28. The fuel composition of claim 27 wherein the dispersant is selected from the group consisting of (i) at least one hydrocarbyl-substituted amine substantially aliphatic and contains at least 8 carbon atoms:

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH—

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

29. The fuel composition of claim 19 wherein (a) is an alkali metal containing composition and (b) is a magnesium containing composition.

30. The fuel composition of claim 25 wherein the sulfonic acid is an alkylated benzene sulfonic acid or alkylated naphthylene sulfonic acid.

31. The fuel composition of claim 19 wherein the fuel is an unleaded fuel.

32. The fuel composition of claim 25 wherein the sulfonate is represented by the formulas $R^1(SO_3H)_r$ or $(R^2)_xT(SO_3H)_y$ in which $R^1$ and $R^2$ are each independently aliphatic groups, $R^1$ contains at least about 15 carbon atoms, the sum of the number of carbon atoms in $R^2$ and T is at least about 15, T is an aromatic hydrocarbon nucleus and x is a number of 1 to 3, r and y are numbers of 1 to to 4.

33. The fuel composition of claim 28 wherein the acylated, nitrogen-containing compound is prepared by reacting a carboxylic acylating agent with at least one amino compound containing at least one —NH— group, said acylating agent being linked to said amino compound through an imido, amido, amidine or acyloxy ammonium linkage.

34. The fuel composition of claim 33 wherein the amino compound is an alkylene polyamine of the general formula:

$$(R^3)_2N[—U—N(R^3)]_n—R^3$$

wherein U is an alkylene group of about 1 to about 18 carbon atoms, each $R^3$ is independently a hydrogen atom, an alkyl group or a hydroxy alkyl group containing up to about 30 carbon atoms, with the proviso that at least one $R^3$ is a hydrogen atom, and n is 1 to about 10.

35. The fuel composition of claim 34 wherein the alkylene polyamine is ethylene, propylene, or trimethylene polyamine of at least 2 to about 8 amino groups, or mixtures of such polyamines.

36. The fuel composition of claim 34 wherein the carboxylic acylating agent is a mono- or polycarboxylic acid, or reactant equivalent thereof, containing an aliphatic hydrocarbyl substituent of at least about 30 carbon atoms.

37. The fuel composition of claim 28 wherein the hydrocarbon-soluble ashless dispersant is an alkenylsuccinimide containing at least about 50 aliphatic carbon atoms in the alkenyl group.

38. The fuel composition of claim 27 wherein the weight ratio of (a) to the hydrocarbon-soluble ashless dispersant is from about 4:0.1 to about 1:4.

39. The fuel composition of claim 19 wherein the alkali metal containing composition is a sodium composition and component (b) is a lithium containing composition.

40. The fuel composition of claim 19 wherein component (b) is a silicon containing composition.

41. The fuel composition of claim 19 wherein component (b) is a boron containing composition.

42. The fuel composition of claim 19 wherein the weight ratio of component (a) to component (b) is from about 5:1 to about 1:25.

43. A fuel composition for internal combustion engines comprising a major amount of a liquid hydrocarbon fuel and minor amount of (a) a hydrocarbon-soluble alkali or alkaline earth metal containing composition and (b) a hydrocarbon-soluble transition metal containing composition.

44. The fuel composition of claim 43 containing less than 0.5 gram of lead per liter of fuel.

45. The fuel composition of claim 43 wherein the fuel contains less than about 0.2 gram of alkali or alkaline earth metal containing composition per liter of fuel.

46. The fuel composition of claim 43 wherein the composition (a) is an alkali metal or alkaline earth metal salt of a sulfur acid, a phosphorus acid, a carboxylic acid or a phenol.

47. The fuel composition of claim 46 wherein (a) is a neutral or basic salt of an organic sulfonic acid.

48. The fuel composition of claim 46 wherein (a) is a neutral salt of an organic sulfonic acid.

49. The fuel composition of claim 43 wherein the transition metal is selected from the group consisting of cerium, manganese, iron, copper and titanium and mixtures thereof.

50. The fuel composition of claim 46 wherein the metal salt is a sodium salt.

51. The fuel composition of claim 43 additionally containing a hydrocarbon-soluble ashless dispersant.

52. The fuel composition of claim 51 wherein the dispersant is selected from the group consisting of (i) at least one hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol, or amine.

53. The fuel composition of claim 43 containing about 1 to about 100 parts per million of alkali metal.

54. The fuel composition of claim 47 wherein (a) is an alkali metal sulfonic acid salt present in an amount sufficient to reduce valve seat recession in an internal combustion engine.

55. The fuel composition of claim 54 wherein the sulfonic acid is an alkylated benzene sulfonic acid or alkylated naphthalene sulfonic acid.

56. The fuel composition of claim 43 wherein the fuel is an unleaded fuel.

57. The fuel composition of claim 52 wherein the acylated, nitrogen-containing compound is prepared by reacting a carboxylic acylating agent with at least one amino compound containing at least one —NH— group, acid acylating agent being linked to said amino compound through an imido, amido, amidine or acyloxy ammonium linkage.

58. The fuel composition of claim 57 wherein the amino compound is an alkylene polyamine of the general formula:

$$(R^3)_2N[—U—N(R^3)]_n—R^3$$

wherein U is an alkylene group of about 1 to about 18 carbon atoms, each $R^3$ is independently a hydrogen atom, an alkyl group or a hydroxy alkyl group containing up to about 30 carbon atoms, with the proviso that at least one $R^3$ is a hydrogen atom, and n is 1 to about 10.

59. The fuel composition of claim 58 wherein the alkylene polyamine is an ethylene, propylene, or trimethylene polyamine of at least 2 to about 8 amino groups, or mixtures of such polyamines.

60. The fuel composition of claim 58 wherein the carboxylic acylating agent is a mono- or polycarboxylic acid, or reactant equivalent thereof, containing an aliphatic hydrocarbyl substituent of at least about 30 carbon atoms.

61. The fuel composition of claim 51 wherein the hydrocarbon-soluble ashless dispersant is an alkenylsuccinimide containing at least about 50 aliphatic carbon atoms in the alkenyl group.

62. The fuel composition of claim 51 wherein the weight ratio of (a) to the hydrocarbon-soluble ashless dispersant is about 1:0.1 to about 1:4.

63. The fuel composition of claim 43 wherein the transition metal is manganese.

64. The fuel composition of claim 63 wherein the transition metal is a manganese carboxylate.

65. A concentrate suitable for use in a fuel containing:

(a) a hydrocarbon soluble alkali metal or alkaline earth metal salt;

(b) a member selected from the group consisting of:

(1) a lead scavenger;

(2) A hydrocarbon-soluble member selected from the group consisting of aluminum containing compositions, silicon containing compositions, molybdenum containing compositions, lithium containing compositions, calcium containing compositions, magnesium containing compositions and mixtures thereof; and (3) a hydrocarbon-soluble transition metal containing composition and mixtures thereof, and (c) a fuel-soluble or dispersible organic diluent.

66. The concentrate of claim 65 containing a hydrocarbon soluble ashless dispersant.

67. A process for reducing valve seat recession by including in an unleaded fuel a hydrocarbon soluble alkali metal or alkaline earth metal containing composition in an amount sufficient to lessen valve seat recession, and a sufficient amount of a scavenger compound capable of lessening the formation of deposits of the alkali metal or alkaline earth metal within the combustion cylinder.

68. The process of claim 67 wherein the scavenger is a halogenated hydrocarbon.

69. The process of claim 67 wherein the scavenger compound contains a transition metal.

70. The process of claim 67 wherein the scavenger compound is selected from the group consisting of boron and aluminum and mixtures thereof.

71. The process of claim 48 wherein the halogenated hydrocarbon is selected from the group consisting of dichloroethane and dibromoethane and mixtures thereof.

72. The process of claim 67 wherein the scavenger is elected from the group consisting of silicon containing compositions, boron containing compositions, cerium containing compositions, iron containing compositions manganese containing composition, copper containing compositions, lithium containing compositions, magnesium containing compositions, and aluminum containing compositions, and mixtures thereof.

73. The process of claim 69 wherein the transition metal is selected from the group consisting of cerium, manganese, iron, copper and titanium and mixtures thereof.

74. The process of claim 67 additionally containing a hydrocarbon soluble ashless dispersant.

75. The process of claim 73 wherein the transition metal is a manganese carboxylate.

* * * * *